US010816261B2

(12) United States Patent
Newman

(10) Patent No.: US 10,816,261 B2
(45) Date of Patent: Oct. 27, 2020

(54) APPARATUS FOR GENERATING PULSED IMPINGEMENT JETS IN FREEZERS

(71) Applicant: Michael D. Newman, Hillsborough, NJ (US)

(72) Inventor: Michael D. Newman, Hillsborough, NJ (US)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/092,949

(22) Filed: Apr. 7, 2016

(65) Prior Publication Data

US 2017/0292758 A1 Oct. 12, 2017

(51) Int. Cl.

| | |
|---|---|
| ***F25D 25/04*** | (2006.01) |
| ***F25D 13/06*** | (2006.01) |
| ***F25D 17/04*** | (2006.01) |
| ***F25D 3/11*** | (2006.01) |
| ***F25D 17/08*** | (2006.01) |

(52) U.S. Cl.

CPC ..... *F25D 25/04* (2013.01); *F25D 13/067* (2013.01); *F25D 3/11* (2013.01); *F25D 17/045* (2013.01); *F25D 17/08* (2013.01)

(58) Field of Classification Search

CPC . F25D 25/04; F25D 3/11; F25D 17/08; F25D 17/045; F25D 13/067; F25D 3/10

USPC ..... 62/380

See application file for complete search history.

(56) References Cited

U.S. PATENT DOCUMENTS

| | | | | |
|---|---|---|---|---|
| 3,315,492 | A * | 4/1967 | Dreksler | A23L 3/361 198/610 |
| 3,427,820 | A * | 2/1969 | Hart | A23L 3/375 62/307 |
| 3,501,925 | A | 3/1970 | Brennan et al. | |
| 3,605,434 | A | 9/1971 | Boese | |
| 4,478,141 | A | 10/1984 | Svensson et al. | |
| 4,569,205 | A | 2/1986 | Dempou et al. | |
| 4,787,152 | A | 11/1988 | Mark | |
| 5,460,015 | A * | 10/1995 | Venetucci | A23L 3/362 62/374 |
| 5,551,251 | A * | 9/1996 | Ochs | A23L 3/361 62/380 |
| 5,797,278 | A | 8/1998 | Rothstein | |

(Continued)

FOREIGN PATENT DOCUMENTS

FR 2316559 A1 1/1977

OTHER PUBLICATIONS

European Search Report for EP16179135.5, dated Feb. 16, 2017, 7 pages.

(Continued)

*Primary Examiner* — David J Teitelbaum
(74) *Attorney, Agent, or Firm* — Donald T. Black

(57) ABSTRACT

An apparatus provides pulsed impingement jets to a sub-chamber within an impingement hood of a freezer, and includes a blower having an inlet and an outlet at an interior of the freezer; a duct having a first end in fluid communication with the outlet and a second end opening into the sub-chamber; and a flow valve disposed in the duct proximate the second end opening, the flow valve movable in repetitive open and closed positions for providing repetitive, discrete pulses of the impingement jets from the second end opening of the duct into the sub-chamber.

9 Claims, 2 Drawing Sheets

(56) References Cited

U.S. PATENT DOCUMENTS

| | | | | |
|---|---|---|---|---|
| 5,901,502 | A | 5/1999 | Rafalski et al. | |
| 2004/0009905 | A1 | 5/2004 | Newman et al. | |
| 2004/0118392 | A1 | 6/2004 | McFadden | |
| 2010/0083687 | A1 | 4/2010 | Handa et al. | |
| 2010/0186423 | A1* | 7/2010 | Veltrop | F25B 21/04 62/3.6 |
| 2017/0038117 | A1* | 2/2017 | Newman | A23L 3/375 |

OTHER PUBLICATIONS

International Search Report for PCT/US2017/025897, dated Jul. 6, 2017, Authorized Officer: Blaine R. Copenheaver, 3 pages.
Written Opinion of the International Searching Authority for PCT/US2017/025897, dated Jul. 6, 2017, Authorized Officer: Blaine R. Copenheaver, 8 pages.

* cited by examiner

APPARATUS FOR GENERATING PULSED IMPINGEMENT JETS IN FREEZERS

BACKGROUND OF THE INVENTION

The present embodiments relate to apparatus and methods to provide pulsed impingement jets in food freezers.

A production capacity or throughput of a cryogenic food freezing tunnel is limited due to its overall heat transfer coefficient. The majority of known food freezing tunnels increase heat transfer by increasing air flow velocities over the products to be chilled or frozen. There are, however, practical and economic limitations to these known methods of increasing heat transfer. Accordingly, the food processing industry seeks efficient and cost-effective methods for increasing the overall heat transfer of a freezing process. This is because an increase in overall heat transfer allows for smaller freezer systems to be fabricated or for increased production rates through existing systems.

An area of opportunity for increasing the overall heat transfer of a freezing process is with the employment of pulsed flow impingement jets. Unfortunately, while lab scale testing has proven the effectiveness of pulse flow impingement, no practical method for pulsing the jets in a full scale impingement freezing tunnel has been developed.

SUMMARY OF THE INVENTION

There is therefore provided an apparatus for providing pulsed impingement jets to a sub-chamber within an impingement hood of a freezer for a food product, which includes a blower having an inlet and an outlet at an interior of the freezer; a duct having a first end in fluid communication with the outlet and a second end opening into the sub-chamber; and a flow valve disposed in the duct proximate the second end opening, the flow valve movable in repetitive open and closed positions for providing repetitive, discrete pulses of the impingement jets from the second end opening of the duct into the sub-chamber.

There is therefore provided the apparatus above, further including a shroud mounted at the interior of the freezer for protecting the blower.

The apparatus may include the blower inlet and the blower outlet being positioned external of the impingement hood.

The apparatus may also include at least one nozzle opening at an interior of the freezer for providing a cryogenic substance to said interior.

The apparatus may further include at least one nozzle opening at the sub-chamber.

Additional features of the present embodiments are described below and set forth in the claims.

BRIEF DESCRIPTION OF THE DRAWINGS

For a more complete understanding of the present invention, reference may be had to the following description of exemplary embodiments considered in connection with the accompanying drawing Figures, of which.

DETAILED DESCRIPTION OF THE INVENTION

Before explaining the inventive embodiments in detail, it is to be understood that the invention is not limited in its application to the details of construction and arrangement of parts illustrated in the accompanying drawings, if any, since the invention is capable of other embodiments and being practiced or carried out in various ways. Also, it is to be understood that the phraseology or terminology employed herein is for the purpose of description and not of limitation.

In the following description, terms such as a horizontal, upright, vertical, above, below, beneath and the like, are to be used solely for the purpose of clarity illustrating the invention and should not be taken as words of limitation. The drawings are for the purpose of illustrating the invention and are not intended to be to scale.

In order to produce effective impingement pulses for use in the food freezers, for example, a pulse must be generated as close as possible to the heat transfer surface (impingement plate of the freezer). It is also much more practical to generate pulses within enclosed volumes. As the volume of the cavity increases around the heat transfer surface, there is created a dampening effect which minimizes the degree of pulsation which can be achieved. Therefore, an enclosed restricted volume is necessary to generate an effective pulse.

The embodiments described provide discrete impingement hoods for generating the pulsed impingement jets. The smaller volume of the hood is a much more suitable environment for generating pulses. The pressure inside the hood for generation of an impingement jet is 2-3 inches of water column. A centrifugal blower is used to generate the gas flow necessary for building pressure in the hood to create the impingement gas flow jets.

In the present embodiments, a secondary high pressure blower is added to coact with the impingement hood. The secondary pressure blower is capable of generating high flows at high static pressures (18-20 inches of water column). Gas from the freezer tunnel feeds the secondary pressure blower and an internal duct connects a discharge of the pressure blower to feed the impingement hood. A damper-type valve is incorporated into the duct from the pressure blower. The damper has a cross-sectional shape and area which does not contact an inner surface of the duct, but instead passes in close proximity thereto and can restrict the majority of flow from the secondary pressure blower.

Figure 1:
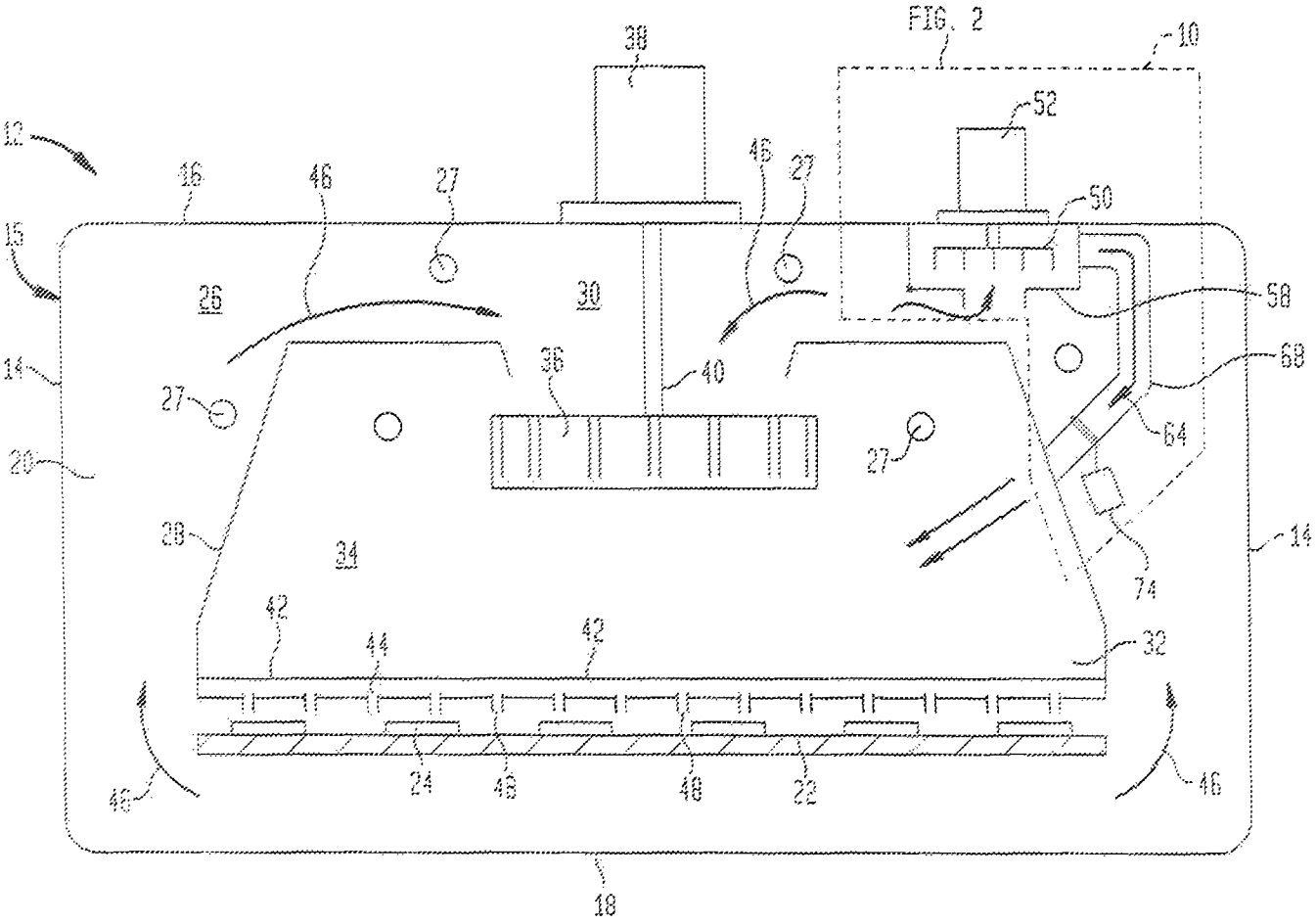
FIG. 1 shows a side view in cross-section of a food freezer having mounted thereto a pulsed impingement jet apparatus according to the present embodiments.
Figure 2:
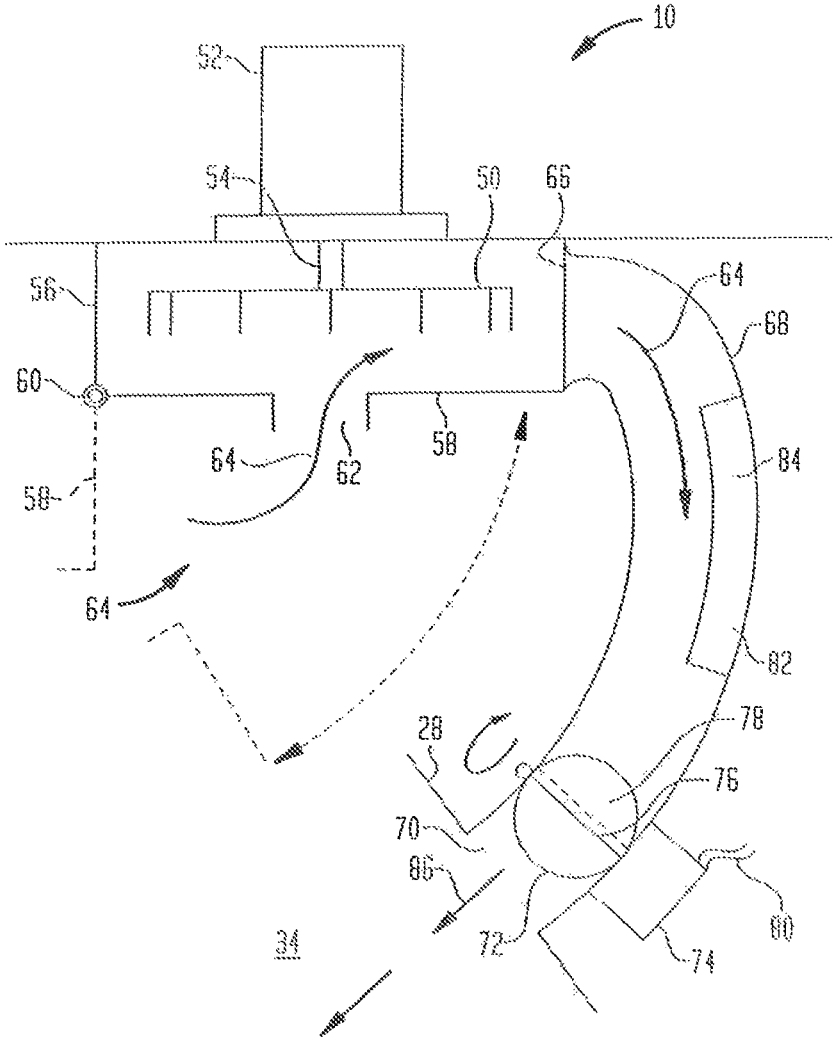
FIG. 2 shows the pulsed impingement jet apparatus of FIG. 1.

Referring to FIGS. 1 and 2, a pulsed impingement jet apparatus embodiment is shown generally at 10 mounted for operation in a freezer 12 such as for example a tunnel freezer. The freezer 12 includes sidewalls 14 for forming a housing 15 having a top 16 and a bottom 18, which also define an internal space 20 through which a conveyor belt 22 will transit. The conveyor belt 22 transports products 24 such as for example food products through the internal space for chilling and/or freezing. The internal space 20 contains a processing atmosphere 26.

An impingement hood 28 is mounted in the internal space 20, the impingement hood having an upper opening 30 and a lower opening 32. The impingement hood 28 defines a sub-chamber 34 in which a main blower 36 is disposed for operation. The main blower 36 is operated by a motor 38 mounted to an exterior of the housing 15 by a shaft 40 that extends through the internal space 20 to the motor.

An impingement plate 42 is mounted at the lower opening 32 of the impingement hood 28 above the conveyor belt 22, which passes below. The impingement plate 42 is provided with the plurality of impingement holes 44 which are in registration with the underlying conveyor belt 22.

A chilling substance (eg, cryogen), and such as for example nitrogen, carbon dioxide, either of which can be in liquid or gaseous state, or cold air or other cold gas, is introduced into the processing atmosphere 26 of the internal space 20 by known apparatus and methods. For example, the cryogen may be injected into the internal space 20 through nozzles 27 connected to pipes (not shown) from a remotely located bulk storage tank (not shown). The nozzles 27 can be positioned at various locations of the internal space 20 as shown, or mounted to a spray bar (not shown) extending into the internal space. Regardless of the cryogen delivery system used, such system should be able to reliably and uniformly disperse the cryogen throughout the internal chamber 20.

The main blower 36 circulates the processing atmosphere 26 as shown by the arrows 46 representing the circulatory flow. The circulatory flow 46 of the chilled processing atmosphere 26 is drawn from the internal space 20 through the upper opening 30 and into the sub-chamber 34 for distribution through the impingement holes 44 and onto the products 24 being transported on the conveyor belt 22 through the internal space. Heat transfer and the related chilling or freezing of the products 24 therefore occurs.

As shown with more particularity in FIG. 2, the apparatus 10 includes a pressure blower 50 disposed in the internal space 20 proximate the top 16 of the housing. Another motor 52 to drive the pressure blower 50 is mounted external to the housing 15 and connected by a shaft 54 extending through the top 16 into the internal space 20 to drive the blower 50.

A shroud 56 is mounted to the top 16 at the internal space 20 to protect the pressure blower 50'which is disposed within the confines of the shroud as shown in FIG. 2. A lower or lid portion of the shroud 56 shown generally at 58 is mechanically hinged at 60 so that the lid can be deployed to an open position to provide access to clean the blower 50 and an internal surface area of the shroud, and then closed. The shroud 56 is provided with an intake opening 62 through which a flow 64 is drawn from the processing atmosphere 26 of the internal space 20 into the shroud by the pressure blower 50, and to thereafter be exhausted through a shroud outlet 66 into a distribution pipe 68 or duct in fluid communication with the outlet. The distribution pipe 68 extends to an exhaust opening 70 in fluid communication with the sub-chamber 34 of the impingement hood 28.

Disposed proximate the exhaust opening 70 is mounted a flow valve 72 controlled by an actuator 74 connected to the valve and mounted external to the distribution pipe 68. The flow valve 72 by way of example includes a rotatable shaft 76 connected to the actuator 74. At least one and in another embodiment a plurality of vanes 78 are attached to the shaft 76, each one of the vanes having a diameter sufficient to span an internal diameter of the distribution pipe 68 but not contact or be inhibited by an internal surface of the distribution pipe so that the vanes are free to rotate with the shaft 76 to which the vanes are attached. The actuator 74 is connected by wires 80 to a controller (not shown) which can be disposed at a remote location.

The distribution pipe 68 includes a cleaning port 82 accessed by a cover 84 which can be mechanically hinged or releasably engaged to the distribution pipe by known connections. The cleaning port 82 permits access to an interior of the distribution pipe 68 for cleaning thereof, and to remove any frozen condensate or other material lodged within the distribution pipe.

In operation and referring to FIGS. 1-2, the main blower 36 continuously circulates a flow of 46 of cryogen gas within the internal space 20 and sub-chamber 34. The gas flow is at atmospheric pressure within the space 20 and is drawn into the upper opening 30 and the main blower 36, where it is pressurized up to 2-3 inches of water column in the sub-chamber 34. The impingement plate(s) 42 set with a 5-10% open area provide sufficient back pressure to create high pressure within the sub-chamber 34. As a result, high velocity (eg, 20 m/s) cryogen gas jets 48 or impingement jets are created and discharged through impingement holes 44 during a steady state operation condition, wherein there is a continuous uniform jet flow through the impingement holes.

When pulsed impingement jets 86 are required, the pressure blower 52 is started and lower pressure gas from the internal space 20 is drawn into the blower 50 and pressurized up to 20 inches of water column within duct 68 when valve 72 is closed. Upon opening of the valve 72, pressure in the duct 68 is released into the internal space 34, thereby increasing the pressure in the internal space 34 for a total of 4-6 inches of water column. During this change in pressure, impingement jet velocities are increased from 20 m/s to 40 m/s. As a result, increased turbulence is created near the surface of the product 24. The valve 72 is only open for a short duration of from 0.5-1 second and then it is closed again, thereby decreasing pressure in the sub-chamber 34, and reducing impingement jet velocities to 20 m/s. Pressure in the duct 68 is increased again to 20 inches of water column. The process continues repeating in this manner with valve 72 opening and dosing the vane(s) 78 at a rate of 30-60 times per minute. Continuous pulsing impingement jets result, with increased turbulence and overall convective heat transfer coefficients at the product 24.

During operation, as the system is running, the "damper" valve continuously rotates providing nearly full flow to no flow from the pressure blower into the impingement hood. The rotational speed of the "damper" results in pressure pulses from the pressure blower entering the impingement hood. Depending on the volume of gas supplied from the pressure blower and the frequency of pulse the pressure in the impingement hood could double or triple and oscillate in this fashion. The impingement jet velocities would also oscillate, thereby creating increased turbulence and higher heat transfer coefficients on the surface of the food product.

The impingement jets can include nitrogen, carbon dioxide, cold air or any other cold gas suitable for use with food products.

It will be understood that the embodiments described herein are merely exemplary, and that a person skilled in the art may make variations and modifications without departing from the spirit and scope of the invention. All such variations and modifications are intended to be included within the scope of the invention as described above and defined the appended claims. It should be understood that the embodiments described above are not only in the alternative, but can be combined.

What is claimed is:

1. An apparatus for providing pulsing, to impingement jets of a cryogen gas that are discharged by a main blower through impingement holes in an impingement plate from and out of a sub-chamber within an impingement hood of a freezer that contains said cryogen gas for freezing a food product, comprising:

a pressure blower having an inlet and an outlet at an interior of the freezer and external to the impingement hood;

a distribution pipe having a first end in fluid communication with the outlet of the pressure blower, and a second end extending to an opening in the impingement hood for fluid communication with the sub-chamber; and a flow valve disposed in the distribution pipe proximate the opening, the flow valve movable in repetitive open and closed positions for providing repetitive, discrete pulsing, to the impingement jets, from the opening at the second end of the distribution pipe into the sub-chamber.

2. The apparatus of claim 1, wherein the cryogen gas is a substance selected from the group consisting of nitrogen, carbon dioxide, cold air, and other cold gas.

3. The apparatus of claim 2, further comprising at least one nozzle opening at the interior of the freezer for providing the substance to said interior.

4. The apparatus of claim 3, wherein the at least one nozzle opening is at the sub-chamber.

5. The apparatus of claim 1, further comprising an actuator operatively associated with the flow valve to provide the repetitive open and closed movement of the flow valve in the distribution pipe.

6. The apparatus of claim 1, further comprising a port in the distribution pipe for accessing an interior of the distribution pipe.

7. The apparatus of claim 1, further comprising a shroud mounted at the interior of the freezer for protecting the blower.

8. The apparatus of claim 7, wherein the shroud further comprises a lid constructed and arranged to be movable for permitting access to the blower and an internal space of the shroud.

9. The apparatus of claim 1, wherein the flow valve comprises at least one vane in the distribution pipe mounted for the repetitive open and closed positions within the distribution pipe.

* * * * *